United States Patent [19]

Peterson et al.

[11] 4,017,997

[45] Apr. 19, 1977

[54] PORTABLE GUN SUPPORT

[75] Inventors: Donald C. Peterson, South Gate; Jack C. Snyder, Yorba Linda, both of Calif.

[73] Assignee: Donald C. Peterson, South Gate, Calif.

[22] Filed: July 25, 1975

[21] Appl. No.: 599,170

[52] U.S. Cl. ..... 42/94

[51] Int. Cl.[2] ..... F41C 29/00

[58] Field of Search ..... 42/94; 89/37 BA

[56] References Cited

UNITED STATES PATENTS

| | | | |
|---|---|---|---|
| 1,295,688 | 2/1919 | Butler | 42/94 |
| 1,618,966 | 2/1927 | Bull | 42/94 |
| 2,569,435 | 9/1951 | Martin | 42/94 |
| 2,991,579 | 7/1961 | Lies | 42/94 |
| 3,007,581 | 11/1961 | Moore | 42/94 |
| 3,703,046 | 11/1972 | Barone et al. | 42/94 |

*Primary Examiner*—Charles T. Jordan
*Attorney, Agent, or Firm*—William C. Babcock

[57] ABSTRACT

A light weight, portable, inexpensive gun support that may be removably secured to the barrel of either a rifle or revolver, with the support including a pair of angularly and longitudinally adjustable legs that permit the support to rest on any desired stationary surface irrespective of the configuration or angulation of the latter. The support when removed from a first position on the barrel of a gun may be disposed in a second compact position to permit the convenient carrying of the latter in a pocket of a garment. The gun support is versatile in use and is particularly adapted for use in hunting, target practice, adjusting sights or adjusting rifle scopes.

1 Claim, 5 Drawing Figures

PORTABLE GUN SUPPORT

BACKGROUND OF THE INVENTION

1. Field of the Invention

Portable Gun Support

2. Description of the Prior Art

Although various types of gun supports have been devised and used in the past, these devices have the operational disadvantages that they are in the main of a complicated mechanical structure, are heavy, bulky and cumbersome, are expensive and as a result have had but limited use.

A major object of the present invention is to provide a gun support that will substantially eliminate the operational disadvantages of prior art devices of this nature by providing a gun support that is light weight, portable, inexpensive, and may be easily and quickly mounted on and removed from the barrel of a gun irrespective of the diameter of the barrel.

Another object of the invention is to supply a gun support that may be disposed in a compact configuration to permit the device to be carried conveniently in the pocket of a garment.

A still further object of the invention is to furnish a gun support that includes a pair of legs that are both angularly and longitudinally adjustable to permit the support to be rested on any stationary nonvertical surface irrespective of the configuration or angulation of the latter.

Another object of the invention is to provide a gun support that requires little or no maintenance and one that is sufficiently versatile that it may be used in hunting, target practice, adjusting sights or adjusting rifle scopes.

SUMMARY OF THE INVENTION

The invention includes a non-abrasive gun barrel supporting block in which a transverse groove of V-shape is defined. The barrel of the gun is removably disposed in the groove and held therein by manually adjustable means mounted on the block. The block is pivotally supported on a head and may be rotated 360 degrees on the latter.

A pair of legs are pivotally supported from the block by manually adjustable means that permit the legs to be selectively disposed at a desired angulation relative to one another. Due to the longitudinal adjustability of the legs and the angular adjustability thereof the invention is adapted to be rested on any non-vertical stationary surface and maintain the barrel of a gun at a steady position relative thereto. The invention when not in use may be disposed in a compact configuration whereby it may be carried conveniently in the pocket of a garment. The invention is versatile as to use and may be employed in hunting, target practice, adjusting sights and adjusting rifle scopes.

DESCRIPTION OF THE PREFERRED EMBODIMENT

Figure 1:
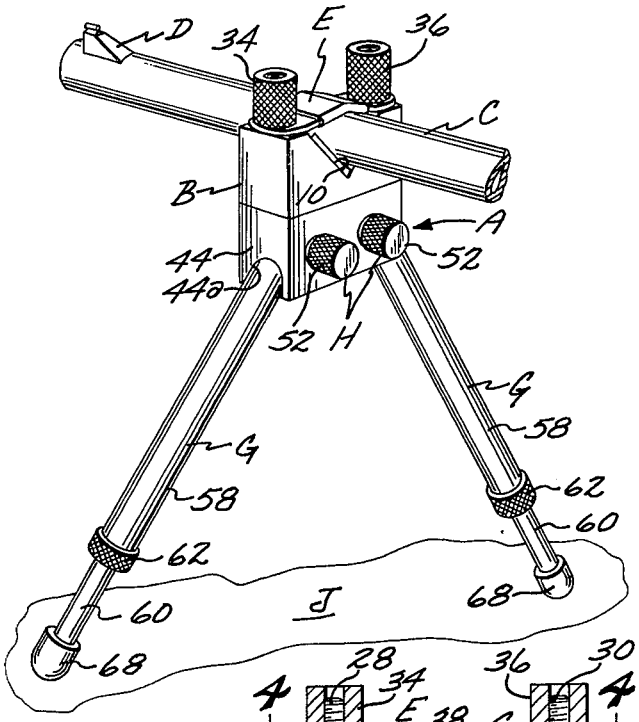
FIG. 1 is a perspective view of the invention removably mounted on the barrel of a gun.
Figure 2:
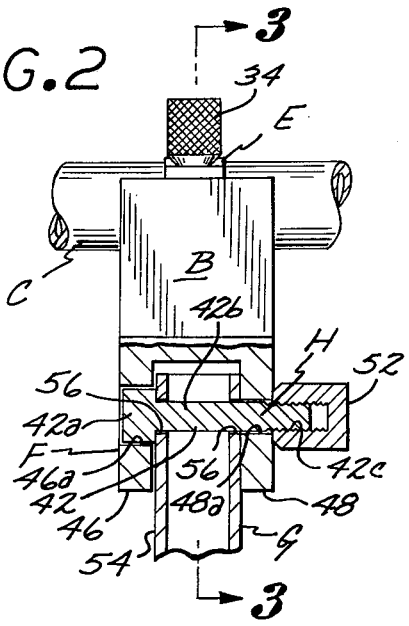
FIG. 2 is a fragmentary combined side elevational and vertical cross sectional view of a portion of the device.
Figure 3:
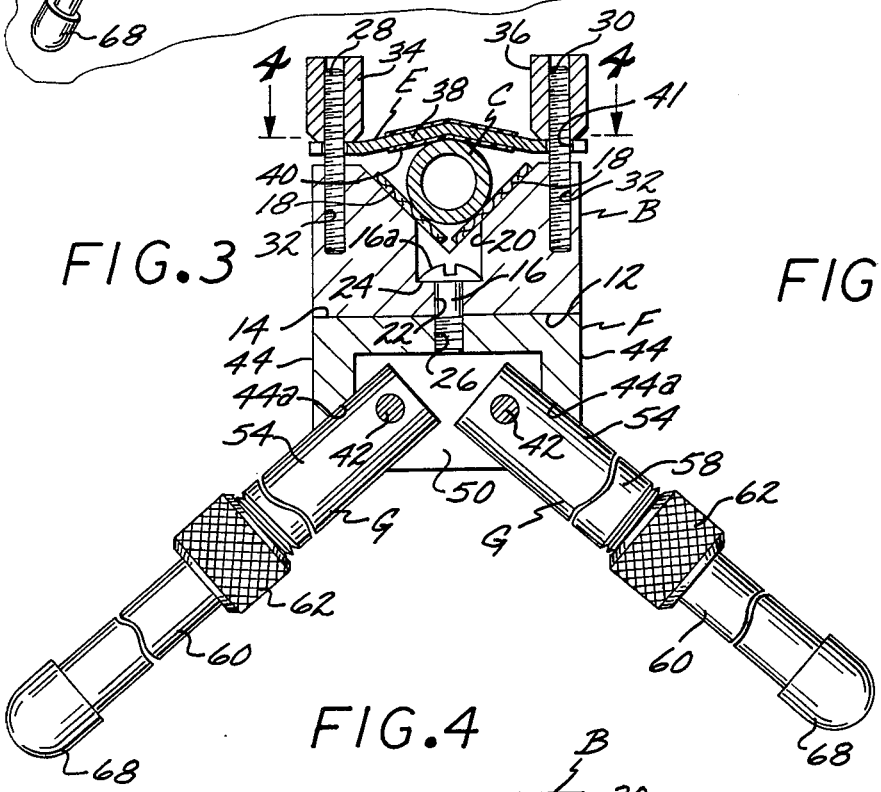
FIG. 3 is a longitudinal cross sectional view of the invention taken on the line 3—3 of FIG. 2.

The portable gun support A as may best be seen in FIGS. 1, 2 and 3, includes a block B that has a transverse groove 10 of V-shape formed therein. A barrel C of a gun having a sight D may be removably disposed in groove 10 to be at least partially supported by block B. Manually adjustable means E, later to be described in detail, are provided to removably lock barrel C in the block.

The barrel supporting block B as may best be seen in FIG. 3, has a lower flat surface 12 that rests on an upper flat surface 14 of a rigid head F. The block B is removably and rotatably supported on head F by a bolt 16.

A pair of longitudinally adjustable legs G are provided that are illustrated as being of tubular structure. Manually adjustable pivot means H are provided that permit the legs to be adjusted to a desired angle therebetween, and locked in this position. Due to the longitudinal and angular adjustability of the pair of legs G, the gun support may be rested on any stationary nonvertical surface J, irrespective of the configuration or angulation of the surface.

Block B is preferably formed from a rigid material such as plastic or the like that is sufficiently soft that it will not scratch or abrade the surface of barrel C when the latter is disposed in groove 10 as shown in FIG. 1. To further safeguard barrel C from being scratched when the barrel is disposed, two soft resilient pads 18 may be provided to be supported in groove 10 as shown in FIG. 1.

Block B has first and second axially aligned bores 20 and 22 formed therein that are normal to lower surface 12, and the bores at their intersection defining a body shoulder 24. Second bore 22 is axially aligned with a tapped bore 26 in head F. The bolt 16 as shown in FIG. 3 extends downwardly through second bore 22 to engage tapped bore 26. By tightening the bolt 16, the head **16*a* thereof may be forced into frictional contact with shoulder 24 to hold the block B at a desired angle on head F. By leaving the bolt 16** in a slightly loose position, the block B may be manually adjusted to any desired angle relative to the head F.

Figure 4:
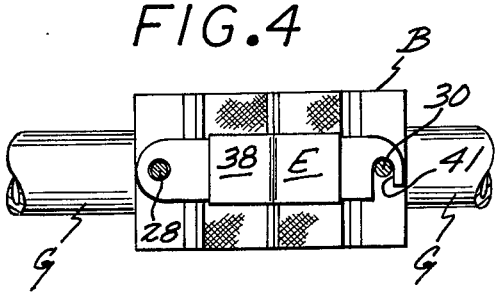
FIG. 4 is a top plan view of the invention taken on the line 4—4 of FIG. 3.
Figure 5:
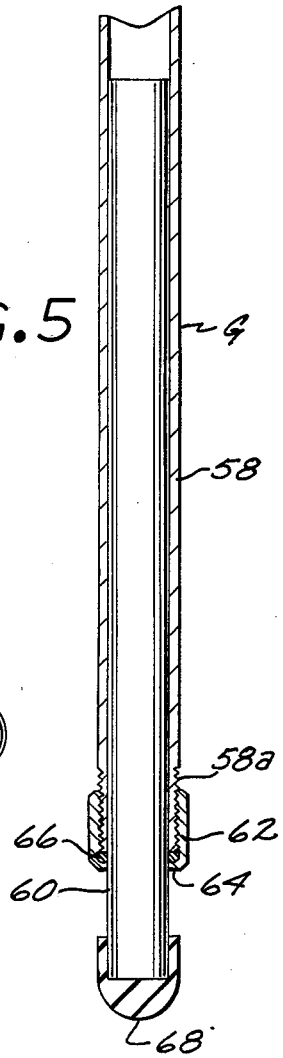
FIG. 5 is a longitudinal cross sectional view of one of the supporting legs.

The manually adjustable means E include two laterally spaced first and second stud bolts 28 and 30 that engage tapped bores 32 that extend downwardly into block B on opposite sides of groove 10. First and second nuts 34 and 36 are provided that engage first and second bolts 28 and 30. First nut 34 serves to removably maintain a crosspiece 38 in a rotatable position on first bolt 28. The end of cross piece 38 most adjacent second stud bolt 30 has a transverse slot 41 therein. When cross piece 38 is pivoted to the position shown in FIG. 4, slot 41 is in engagement with second stud bolt 30, and first and second nuts 34 and 36 may now be tightened to force the cross piece 38 into engagement with barrel C. Barrel C is now removably gripped between cross piece 38 and groove 10, and is held at a stationary position relative to block B. Cross piece 38 preferably has soft protective film 40 on at least a part of the exterior surface to prevent the cross piece scratching gun barrel C when the barrel is in the position shown in FIGS. 1 and 3.

The adjustable pivot means H include two parallel laterally spaced bolts 42 that have heads 42*a* and shanks 42*b* on which threads 42*c* are formed as shown in FIG. 2. Head F includes a pair of end walls 44 and first and second sidewalls 46 and 48 that cooperate to define an upwardly extending cavity 50. First and second side walls 46 and 48 have two pairs of axially aligned first and second bores 46*a* and 48*a* formed therein, and through which the bolts 42 extend as shown in FIGS. 2 and 3. The threads 42*c* are engaged by nuts 52 as shown in FIGS. 1 and 2. Legs G have upper end portions 54 that are disposed in cavity 50. End portions 54 have transversely aligned bores 56 therein through which shanks 42*b* extend. In FIG. 2 it will be seen that when nuts 52 are tightened, the end portions 54 of legs G are forced into frictional contact with the interior surface of second side wall 48 as well as heads 42*a* and the legs G are locked in a desired angle relative to one another. The end walls 44 have slots 44*a* formed therein that are in communication with cavity 50, with the legs G being pivoted outwardly through the slots as shown in FIG. 3.

Each of the legs G is defined by a first upper section and a second lower tubular section 58 and 60 of such internal cross section that the second section is telescopically adjustable relative to the first section. Each first section 58 has threads 58*a* formed on the lower end thereof, which threads are engaged by a nut 62 that has an inwardly extending lip 64 on which a resilient deformable ring 66 rests. When nut 62 is tightened to force ring 66 into pressure contact with the lower end of first section 58, the ring 66 expands radially to frictionally engage the exterior surface of second section 60 and hold the second section at a desired longitudinal position relative to the first section 58 with which it is associated. Each second section 60 has a resilient tip 68 mounted on the lower end thereof.

The use and operation of the gun support A has previously been explained and need not be repeated. After the support A has been removed from the barrel C, the nuts 62 are loosened to permit the second leg sections 60 to be telescoped into the first section 58. Nuts 52 when loosened permit the legs G to be pivoted towards one another to a second position where the tips 68 contact one another. The support A is now in a compact configuration and may be carried in the pocket of a garment (not shown). The upper extremities of slots 44*a* serve as stops to limit the outward pivotal movement of legs G on head F, with tips serving the same function for inward pivotal movement of the legs.

We claim:

1. A portable gun support that may be removably secured when in a first position to a gun barrel to support the latter from a stationary surface that may be of irregular configuration to shoot in a substantially horizontal direction, said gun support when not in use capable of being disposed in a compact second position where it may be carried conveniently in the pocket of a garment worn by a user of said gun support, said gun support including:

a. a block having a transverse padded groove of V-shape formed therein, said groove permitting gun barrels of different diameter to be disposed therein;

b. first padded means for removably locking said block to said gun barrel when the latter is disposed in said groove, said first means including a padded cross piece pivotally supported from said block and capable of being disposed in a first position to removably engage said barrel when the latter is disposed in a groove; and a lock for removably holding said cross piece to engage said barrel;

c. a head;

d. a pair of legs, each of said legs including first and second tubular sections, said second section being telescopically movable in said first section;

e. second means on each of said legs for removably locking said second sections at a desired longitudinal position relative to said first sections, said second means including:

1. threads formed on the free ends of said first leg sections;
2. two nuts that engage said threads, said nuts having inwardly extending lips; and
3. two resilient rings that rest on said lips and are expanded radially to frictionally grip said second sections when said nuts are tightened by rotating said nuts relative to said threads;

f. third means for pivotally supporting said first leg sections from said head and for locking said legs at a desired angle relative to one another;

g. fourth means for pivotally supporting said block from said head, with said second and third means permitting said block and head when said gun support is in said first position to be supported from an irregular or angularly inclined surface and said fourth means permitting said block and gun barrel to be pivoted in a substantially horizontal plane, and said first means permitting said gun support to be removed from said barrel to permit said third and fourth means to be used to dispose said gun support in said second position where said second leg sections are telescoped substantially into said first leg sections, with said legs adjacently disposed to one another; and h. resilient tips mounted on free ends of said second sections.

* * * * *